US006000065A

United States Patent [19]

Deagan

[11] Patent Number: 6,000,065

[45] Date of Patent: Dec. 14, 1999

[54] METHOD AND APPARATUS FOR HELMET REMOVAL

[76] Inventor: John C. Deagan, 3715 R.F.D., Long Grove, Ill. 60047

[21] Appl. No.: 09/195,911

[22] Filed: Nov. 19, 1998

[51] Int. Cl.[6] ..... A42B 3/00

[52] U.S. Cl. ..... 2/410; 2/425; 223/111

[58] Field of Search ..... 2/410, 411, 414, 2/417, 421, 422, 423, 424, 425; 223/111

[56] References Cited

U.S. PATENT DOCUMENTS

| | | | |
|---|---|---|---|
| 5,428,845 | 7/1995 | Deagan | 2/413 |
| 5,566,398 | 10/1996 | Deagan | 2/413 |
| 5,787,513 | 8/1998 | Sharmut et al. | 2/411 |

*Primary Examiner*—Michael A. Neas
*Attorney, Agent, or Firm*—Thomas R. Vigil

[57] ABSTRACT

Then apparatus for assisting in the removal of a helmet from a wearer thereof, particularly when the wearer is unconscious or injured, comprises: a framework constructed, sized and arranged to fit around a conventional helmet; an engaging mechanism for engaging the inside of a jaw covering portion on each side of the helmet; and an actuating means for causing at least one of the engaging mechanism to be moved laterally outwardly to spread apart the jaw covering portions of the helmet to facilitate removal of the helmet from the head of the wearer.

The method for assisting in the removal of a helmet from a wearer thereof, particularly when the wearer is unconscious or injured, comprises the steps of: arranging a framework constructed to fit around a conventional helmet, around a helmet; engaging with an engaging mechanism the inside of a jaw covering portion on each side of the helmet; and moving with a moving mechanism at least one of the engaging mechanisms laterally outwardly to spread apart the jaw covering portions of the helmet to facilitate removal of the helmet from the head of the wearer.

6 Claims, 2 Drawing Sheets

METHOD AND APPARATUS FOR HELMET REMOVAL

BACKGROUND OF THE INVENTION

1. Field of the Invention.

The present invention relates to a method and apparatus for removing a helmet from the head of an individual wearing same after he or she has suffered some injury or is unconscious.

2. Description of the Prior Art.

Heretofore various methods and apparatus have been proposed for removing helmets from injured wearers thereof, such as football players, motorcycle riders, hockey players, etc.

An example of the use of an inflatable bladder inside a helmet for being inflated after the wearer of the helmet is injured is disclosed in the prior Deagan U.S. Pat. No. 5,428,845, the disclosure of which is incorporated herein by reference.

Although the prior art method of using an inflatable bladder is effective in removing the helmet from the head of a wearer, there is still the problem of the pinching or compression from the sides of the helmet that cover the ears and part of the jaw of the wearer, such that the helmet does not come off a wearer's head easily when an inflatable bladder inside the helmet above the head is inflated.

As will become more apparent from the following description of the invention in conjunction with the drawings, the method and apparatus of the present invention provide a means for separating or spreading apart the jaw/ear covering sections of the helmet to facilitate an easy "slide off" removal of the helmet from the wearer's head.

SUMMARY OF THE INVENTION

According to the teachings of the present invention there is provided an apparatus for assisting in the removal of a helmet from a wearer thereof, particularly when the wearer is unconscious or injured, the apparatus comprising: a framework constructed, sized and arranged to fit around a conventional helmet; an engaging mechanism for engaging the inside of a jaw covering portion on each side of the helmet; and an actuating means for causing at least one of the engaging mechanism to be moved laterally outwardly to spread apart the jaw covering portions of the helmet to facilitate removal of the helmet from the head of the wearer.

Further according to the present invention, there is provided a method for assisting in the removal of a helmet from a wearer thereof, particularly when the wearer is unconscious or injured. The method comprises the steps of: arranging a framework constructed to fit around a conventional helmet, around a helmet; engaging with an engaging mechanism the inside of a jaw covering portion on each side of the helmet; and moving with a moving mechanism at least one of the engaging mechanisms laterally outwardly to spread apart the jaw covering portions of the helmet to facilitate removal of the helmet from the head of the wearer.

DESCRIPTION OF THE PREFERRED EMBODIMENT(S)

Figure 1:
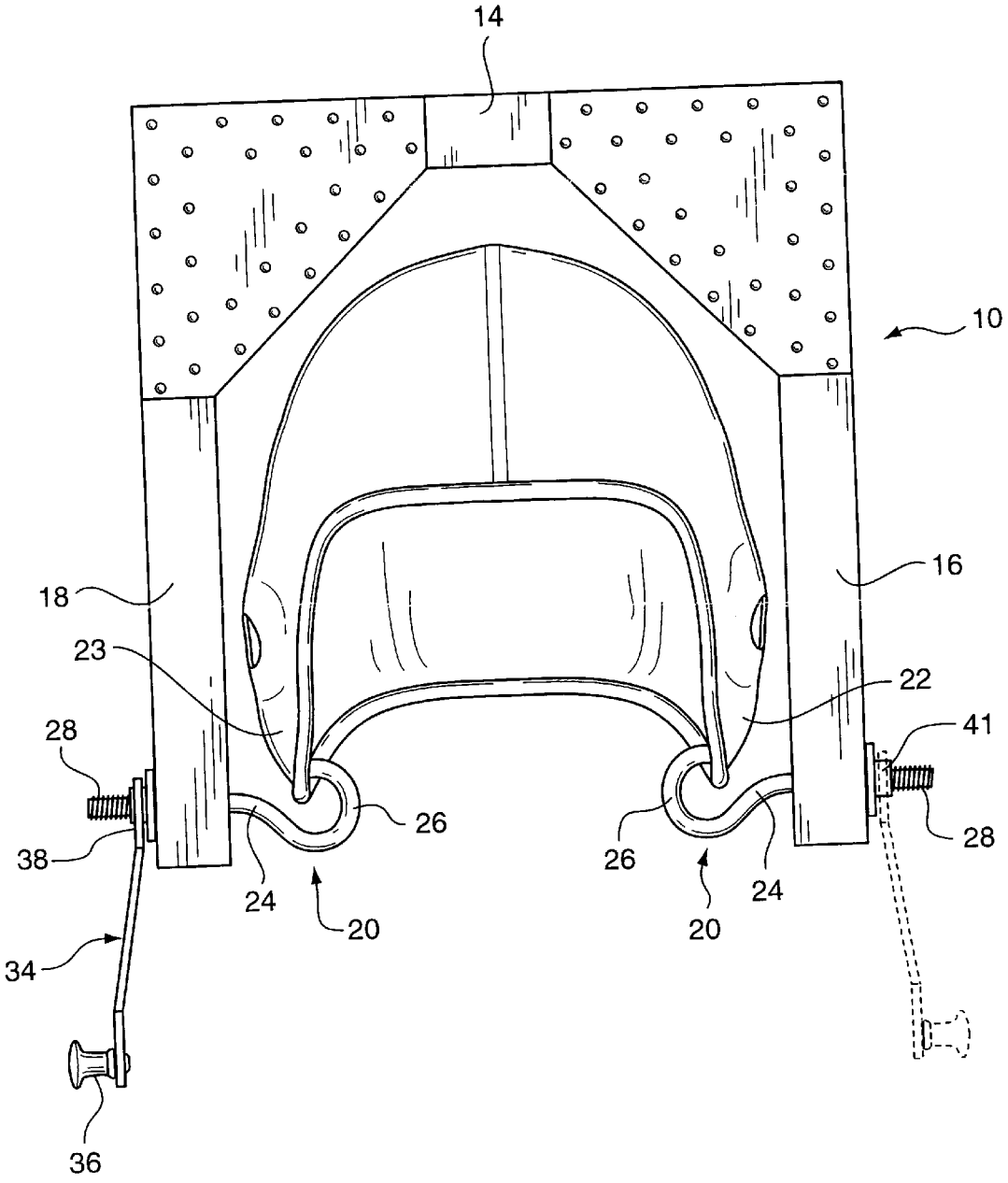
FIG. 1 is a plan view of one embodiment of the apparatus of the present invention mounted around a helmet for enabling the lower jaw engaging or ear covering portions of the helmet to be pulled apart or spread apart from each other so that the helmet can be easily "slipped off" the head of the wearer.

Referring now to FIG. 1, there is illustrated therein one embodiment of an apparatus 10 for removing a helmet 11 from a wearer's head. The apparatus 10 includes a U-shaped framework 12 which is constructed, sized and arranged to be big enough to be received over a helmet worn, for example, by an athlete or a rider of a motorcycle.

The framework 12 includes a bight portion 14 and two leg portions 16 and 18. It will be understood that the bight portion 14 must be strong enough to hold the leg portions 16 and 18 from bending laterally inwardly from the U-shaped framework 12 when the apparatus 10 is being used. For this reason, in the illustrated embodiment, the bight portion 14 is rather wide relative to the width of the leg portions 16 and 18.

Each leg portion 16, 18 has, at its outer end not connected to the bight portion 14, a mechanism 20 for engaging a jaw covering or ear covering portion 22, 23 of a helmet 11. In the illustrated embodiment, this mechanism 20 includes a hook member 24 having a hook-shaped end 26 and a threaded stem 28.

As shown, the stem 28 extends through a non-threaded hole 30 (FIG. 2) extending transversely or laterally through each leg portion 16, 18. It will be understood that the hook member 24 has the hook end 26 for engaging the inner side 31 (FIG. 2) of a jaw covering portion 22, 23 of a helmet 11. The stem 28 extends through the hole 30 to an actuator 32 which can be a ratchet type actuator for pulling the engaging mechanism 20 laterally outwardly from the helmet 11 or a crank type actuator as shown.

The illustrated actuator 32 is operated to move the helmet engaging mechanism 20 laterally outwardly so as to pull the jaw covering portions 22, 23 of the helmet 11 away from each other to permit the helmet 11 to be easily slid off a wearer's head.

In the illustrated embodiment, the actuator 32 includes a crank handle 34 having a crank arm 36 at one end and a body portion 38 at the other end having a threaded throughbore 40 therein for being received over the threaded stem 28.

The body portion 38 of the crank handle 34 is threadably received on the outer end of the threaded stem 28. Then, rotation of the crank handle 34 causes the body portion 38 to engage an outer surface of a leg portion 16 or 18 causing the hook end 26 to move laterally outwardly toward one of the leg portions 16 or 18.

Figure 2:
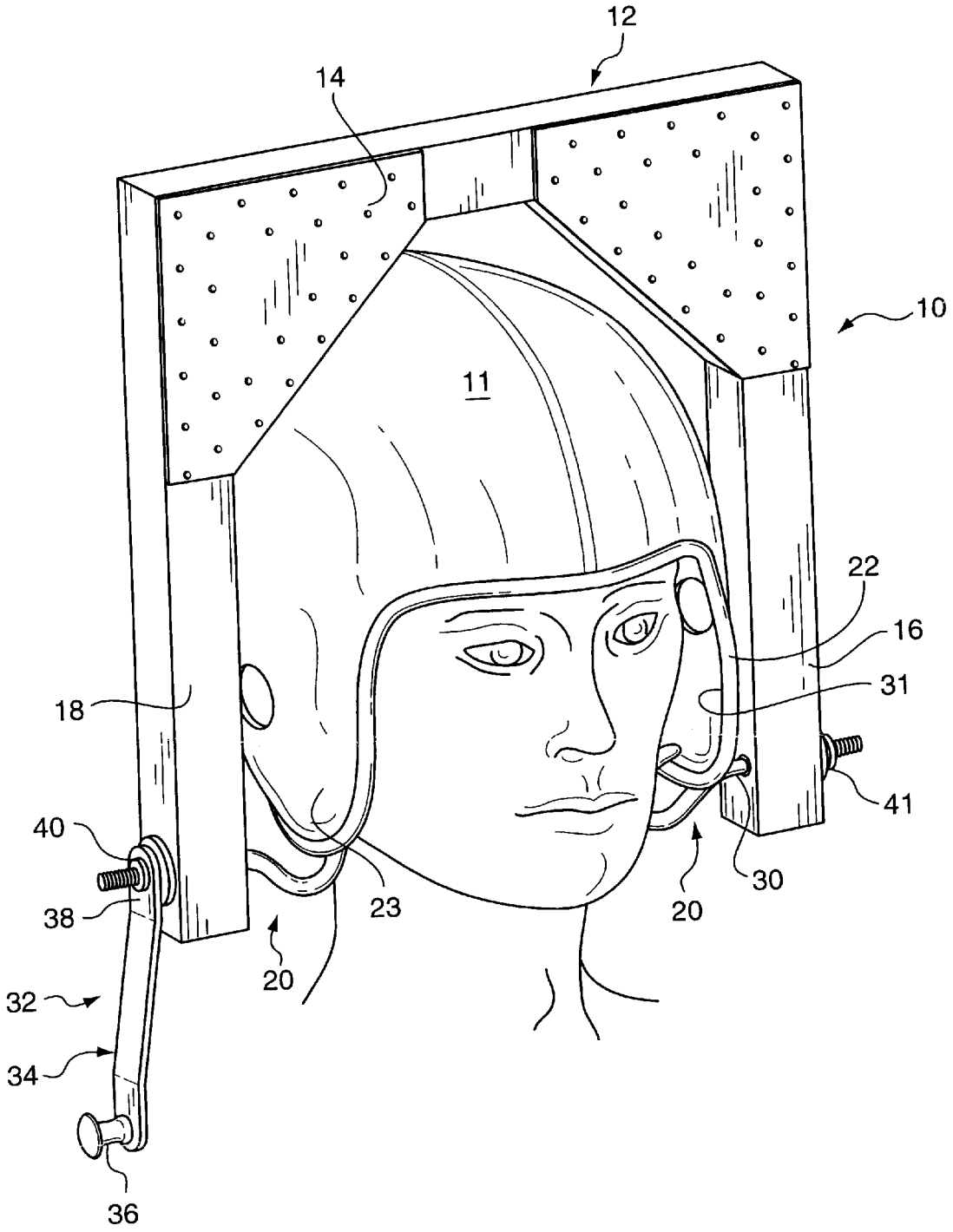
FIG. 2 is a perspective view of the apparatus of the present invention engaging a helmet positioned over a wearer's head and engaging the helmet for pulling the jaw covering portions of the helmet away from the wearer's jaws to facilitate easy removal of the helmet from the wearer's head.

In use, the hook ends 26 are positioned to engage the inner surface 31 of each jaw covering portion 22, 23 of the helmet 11, as shown in FIG. 2. Then by gripping the crank arm 36 of the crank handle 34, one can rotate the crank handle 34 to move the body portion 38 on the threaded stem 28 thereby causing the threaded stem 28 to move axially outwardly and, in so doing, pull the jaw covering portion 22 or 23 of the helmet 11 away from the wearer's head.

It will be appreciated that in the illustrated embodiment only one actuator 33 is provided. However, two hook members 24 each with a hook end 26 and a threaded stem 28 are provided each extending through a throughbore 30 that extends laterally and transversely of and through an outer end portion of each leg portion 16, 18. This enables the apparatus 10 to engage both sides of the helmet 11. In this respect, a nut 41 is mounted to one threaded stem 28 and tightened down to a point whereby the hook end 26 of that hook member 24 can be positioned inside a jaw covering portion 22 or 23 of the helmet 11 for engaging same.

It will be appreciated that the actuator on one side of the apparatus 10 causes one hook end 26 to move laterally outwardly thereby to spread apart the jaw covering portions 22, 23.

Alternatively, however, one could have two crank handles 34 on each side of the helmet removing apparatus 10, instead of one crank handle 34 and one nut 41, as shown in phantom in FIG. 1. However, it is believed that one crank handle 34 will be sufficient, since the other jaw covering or ear covering portion 22, 23 of the helmet 11 do not have to be pulled laterally outwardly from the wearer's head but can be held stationary while the first named jaw covering portion or ear covering portion 22 or 23 is moved away from the other side of the wearer's head. In either case, the jaw covering portions 22, 23 of the helmet 11 will be pulled away from each other allowing the helmet 11 easily to be slid off the head of the wearer.

From the foregoing description, it will be apparent that the method for using the apparatus 10 comprises placing the apparatus 10 over the helmet of a wearer thereof, who may or may not be unconscious; positioning the hook members 24 so that the hook ends 26 of each hook member 24 is positioned within the helmet 11 for engaging the inside 31 of a lower jaw covering portion 22, 23 of the helmet 11; followed by rotating one or two crank handles 34 to pull the jaw covering portions 22, 23 of the helmet 11 away from each other or to cause relative movement therebetween so that a lower opening of the helmet 11 is widened to enable the helmet 11 to be easily slid off a wearer's head.

Also, from the foregoing description, it will be apparent that the method and apparatus 10 of the present invention have a number of advantages, some of which have been described above and others of which are inherent in the invention. In particular, the simple apparatus 10 of the present invention enables easy removal of a helmet from an injured wearer thereof. Furthermore, it will be understood that modifications can be made to the method and apparatus 10 without departing from the teachings of the invention. Accordingly, the scope of the invention is only to be limited as necessitated by the accompanying claims.

I Claim:

1. An apparatus for assisting in the removal of a helmet from a wearer thereof, particularly when the wearer is unconscious or injured, said apparatus comprising:

a framework constructed, sized and arranged to fit around a conventional helmet;

engaging means for engaging the inside of a jaw covering portion on each side of the helmet; and actuating means for causing at least one of said engaging means to be moved laterally outwardly to spread apart the jaw covering portions of the helmet to facilitate removal of the helmet from the head of the wearer.

2. The apparatus of claim 1 wherein said engaging means comprises a hook member, including a hook end and a stem.

3. The apparatus of claim 2 wherein said framework includes two leg portions for being placed on either side of the helmet, each leg portion having a laterally or transversely extending throughbore and said stem of each hook member extending through said throughbore.

4. The apparatus of claim 3 wherein said actuating means comprises a crank handle having a crank arm at one end and a body portion at the opposite end, said stem being threaded and said body portion having a threaded throughbore for threadably receiving said stem whereby rotation of said crank handle will cause said body portion to bear against an outer side of one of said leg portions, thereby causing at least one hook end to be moved laterally outwardly away from said helmet to spread apart the jaw covering portions.

5. A method for assisting in the removal of a helmet from a wearer thereof, particularly when the wearer is unconscious or injured, said method comprising the steps of:

arranging a framework constructed to fit around a conventional helmet, around a helmet;

engaging with engaging means the inside of a jaw covering portion on each side of the helmet; and moving with moving means at least one of said engaging means laterally outwardly to spread apart the jaw covering portions of the helmet to facilitate removal of the helmet from the head of the wearer.

6. The method of claim 5 wherein said engaging means comprises a hook member, including a hook end and a stem, said framework including two leg portions for being placed on either side of the helmet, each leg portion having a laterally or transversely extending throughbore, said stem of each hook member extending through said throughbore, and said moving means comprising a crank handle having a crank arm at one end and a body portion at the opposite end, said stem being threaded and said body portion having a threaded throughbore for threadably receiving said stem whereby rotation of said crank handle will cause said body portion to bear against an outer side of one of said leg portions, thereby causing at least one hook end to be moved laterally outwardly away from said helmet to spread apart the jaw covering portions.

* * * * *